US006223544B1

(12) United States Patent
Seem

(10) Patent No.: US 6,223,544 B1
(45) Date of Patent: May 1, 2001

(54) INTEGRATED CONTROL AND FAULT DETECTION OF HVAC EQUIPMENT

(75) Inventor: John E Seem, Glendale, WI (US)

(73) Assignee: Johnson Controls Technology Co., Plymouth, MI (US)

( * ) Notice: Subject to any disclaimer, the term of this patent is extended or adjusted under 35 U.S.C. 154(b) by 0 days.

(21) Appl. No.: 09/368,972

(22) Filed: Aug. 5, 1999

(51) Int. Cl.[7] ..... F25B 49/02
(52) U.S. Cl. ..... 62/127; 236/94
(58) Field of Search ..... 62/125, 126, 127, 62/129, 130; 236/94; 165/11.1

(56) References Cited

U.S. PATENT DOCUMENTS 4,325,223 * 4/1982 Cantley ..... 62/126
4,611,470 * 9/1986 Enström ..... 62/127
5,582,021 * 12/1996 Masauji ..... 62/126
5,963,458 * 10/1999 Cascia ..... 62/129 X

* cited by examiner

*Primary Examiner*—Harry B. Tanner
(74) *Attorney, Agent, or Firm*—Quarles & Brady; George E. Haas

(57) ABSTRACT

Fault detection is implemented on a finite state machine controller for an air handling system. The method employs data, regarding the system performance in the current state and upon a transition occurring, to determine whether a fault condition exists. The fault detection may be based on saturation of the system control or on a comparison of actual performance to a mathematical model of the air handling system. As a consequence, the control does not have to be in steady-state operation to perform fault detection.

24 Claims, 6 Drawing Sheets

INTEGRATED CONTROL AND FAULT DETECTION OF HVAC EQUIPMENT

FIELD OF THE TECHNOLOGY

The present invention relates to control systems for eating, ventilating and air conditioning (HVAC) systems, and in particular to mechanism that detect fault conditions in such systems.

BACKGROUND OF THE INVENTION

Central air handling systems provide conditioned air to rooms within a building. A wide variety of such systems exist such as constant volume and variable-air-volume air-handling units (A.U.). In a typical A.U. 10, as shown in FIG. 1, air returns from the conditioned rooms through the return air duct 11 being drawn by a return fan 12. Depending on the positions of an exhaust damper 13 and a recirculation damper 14, the return air may be exhausted outside the building or go from the return air duct 11 to a mixed air plenum 15, becoming recirculated air. In the mixed air plenum 15, fresh outside air, drawn through inlet damper 16,is mixed with recirculated air, and the mixture then passes through a filter 17, a cooling coil 18, a heating coil 19, and a supply fan 20. The temperatures and flow rates of the outdoor and recirculated air streams determine the conditions at the exit of the mixed air plenum. At most only one of the cooling and heating coils 18 or 19 will be active at any given time assuming the sequencing control strategy is implemented properly and there are no valve leaks or other faults in the system. After being conditioned by the coils, the air is distributed to the zones through the supply air duct 21.

The cooling coil 18, heating coil 19, and dampers 13, 14 and 16 of air-handling unit 10 are operated by a feedback controller 22 having control logic which determines the proper combination of system components to activate for maintaining the supply air temperature at the desired value at any given time. The controller 22 implements a control strategy which regulates the mixture of outside air with mechanical cooling or heating provided by the coils 18 and 19 to efficiently condition the air being supplied to the rooms. Such control is predicated on receiving accurate sensor data regarding conditions in the rooms and outside the building, as well as within the air handling unit 10. The controller 22 receives an input signal on line 26 which indicates the desired temperature (a control setpoint) for the supply air temperature. An outdoor air temperature sensor 23 provides a signal indicative of the temperature of the air entering the system and a supply air temperature sensor 24 produces a signal which indicates the temperature of the air being fed to the supply air duct 21. An optional sensor 25 may be installed to sense the temperature of the air in the return air duct 11.

A number of faults may occur which adversely affect the operation of the air handling unit 10. For example, a sensor error, such as a complete failure, an incorrect signal or excessive signal noise, can produce faulty operation. In addition errors may be due to stuck or leaky dampers and valves for the heating and cooling coils 18 and 19, as well as fan problems.

Previous approaches to providing a robust control system that was more immune from fault related problems utilized multiple sensors to measure the same physical quantity and special sensors for directly detecting and diagnosing faults. Other approaches involved limit checking in which process variables are compared to thresholds, spectrum analysis for diagnosing problems, and logic reasoning approaches.

Many of the previous fault detection and diagnostic techniques for HVAC systems were based on analyzing the system after it has reached a steady-state condition. Observations of process inputs and outputs enter the steady-state fault detection system which then determines if the system has been operating in steady-state. If the system reaches a steady-state condition, then the fault detection system can determine whether faults are present. If the system does not reach a steady-state condition, then the fault detection system issues a command that the system is not in steady-state. Non-steady state operation can be caused by poorly tuned control systems, oversized control valves, or control valves with poor authority.

The HVAC industry is very cost sensitive. Consequently, there often are very few sensors installed on HVAC systems, which makes it difficult to detect faults when only a few parameters are being monitored. In addition, the behavior of HVAC equipment is non-linear and loads are time varying; factors which further complicate accurate fault detection.

SUMMARY OF THE INVENTION

The present invention is a new method for integrated control and fault detection of air-handling systems which are operated by a finite state machine controller. The method can be used to detect faults in existing air handling units without having to incorporate additional sensors. The control system does not have to be in steady-state operation to perform fault detection, i.e., the control loops may be oscillating due to poor tuning or a limit cycle due to oversized valves or too small a valve authority. The present control method is fault tolerant, in that if a fault is detected, the system still is able to maintain control of the air handling unit. The method described is able to detect a number of faults in air-handling systems, such as stuck dampers and actuators, a too high or too low ventilation flow, leaking air dampers, and leakage through closed heating and cooling valves.

The fault detection method includes gathering operational data regarding performance of the HVAC system. That operational data occasionally is evaluated against predefined criteria either for a current state in which the finite state machine controller is operating or for a given transition which has occurred. Based on results of the evaluation, a determination is made whether an fault condition exists.

In the preferred embodiment, the operational data is checked when the controller is in a given state to determined whether the HVAC system control is saturated in a manner that can not be overcome by a transition to another state. Saturation occurs when controller remains in a given operational mode for a predetermined period of time without being able to adequately control the environment of the building. For example, the controller is in the mechanical heating mode, but can not heat the environment to the desired temperature.

Preferably the fault detection method may compare the actual performance to a model of the HVAC system upon the occurrence of a transition between control states. Such a comparison can produce a residual value indicative of the degree that the actual performance matches the model. The magnitude of the residual then is employed to determine whether a fault condition exists and the possible causes.

DETAILED DESCRIPTION OF THE INVENTION

Figure 1:
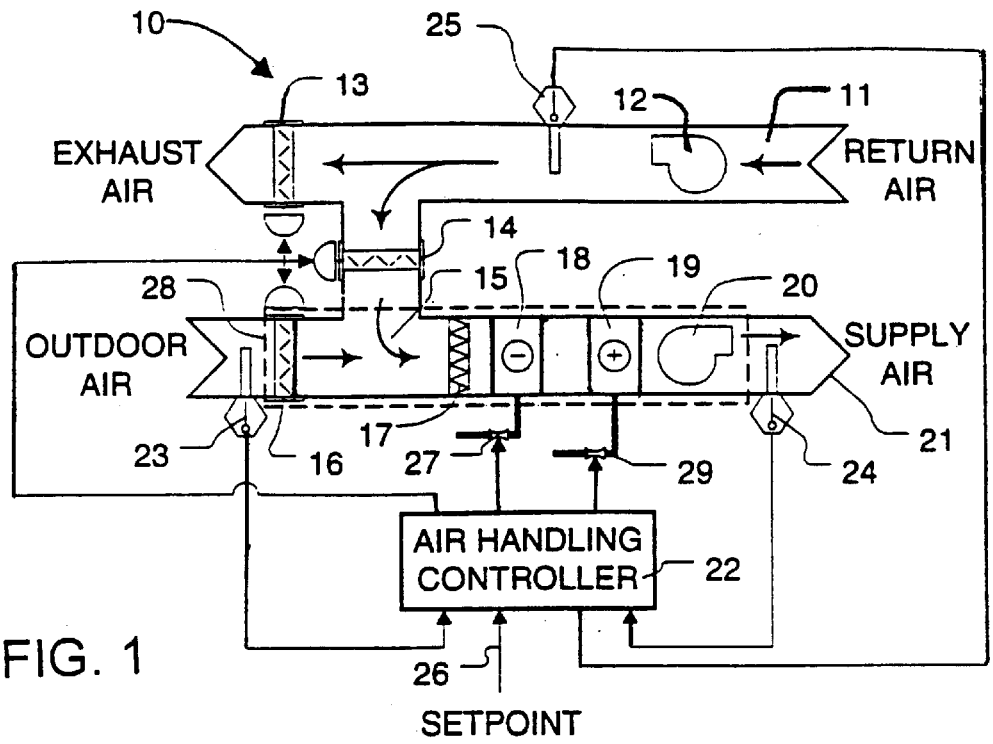
FIG. 1 is a schematic diagram of a variable air volume air handling unit used in previous HVAC systems.
Figure 2:
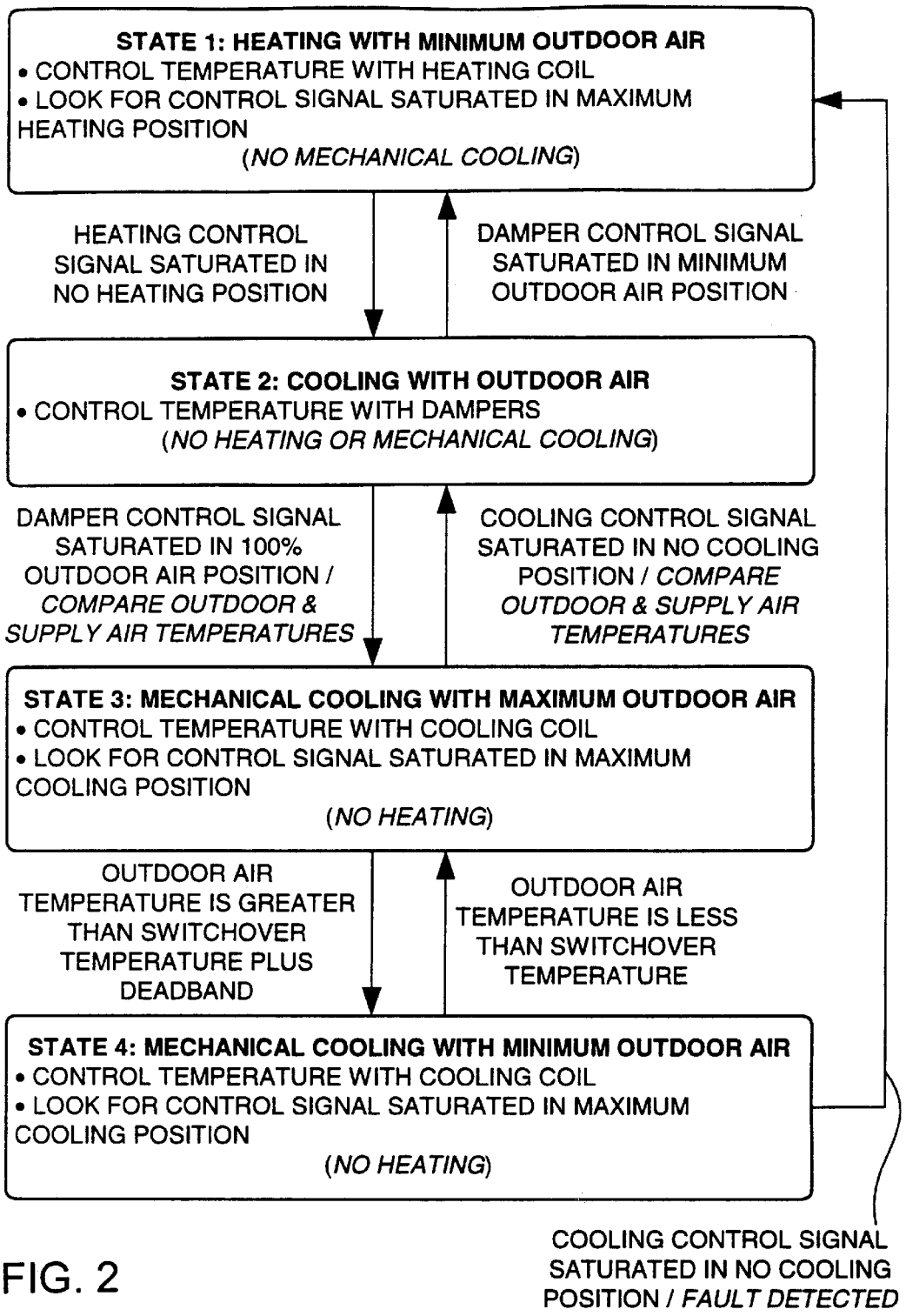
FIG. 2 is a state machine diagram for the operation of the controller in the air handling unit.

With reference to FIGS. 1 and 2, the air handling controller 22 is programmed to implement a finite state machine which provides sequential control of the components in air handling unit 10. In the preferred embodiment, there are four states State 1-Heating, State 2-Free cooling, State 3-Mechanical Cooling With Maximum Outdoor Air and State 4-Mechanical Cooling With Minimum Outdoor Air. The signals from the temperature sensors 23 and 24, the positions of the dampers 13, 14 and 16, and other conditions of the air-handling unit 10 are examined to determine when a transition from one state to another should occur.

In State 1-Heating, feedback control is used to modulate the amount of energy transferred from the heating coil 19 to the air. This embodiment of the air-handling unit 10 employs the hot water heating coil 19, although steam or electrically powered heaters may be used. The dampers 13, 14 and 16 are positioned to provide the minimum amount of outdoor air required for ventilation and the cooling coil valve 27 is closed.

A transition to State 2 occurs after the output of the controller 22 has been saturated in the no heating position. Saturation is defined as the controller remaining in a given mode for a predetermined period of time without being able to adequately control the environment of the associated rooms. Saturation may indicate the need for a transition to another state or a fault condition, as will be described later. In the no heating mode, saturation is considered to exist when heating is not required for a predefined period of time and the supply air temperature is greater than the setpoint. For example, the predefined period of time may be equal to the state transition delay, which is an interval that must elapse after a transition into State 1 before another transition may occur. The state transition delay prevents oscillation between a pair of states.

In State 2-Free cooling, feedback control is used to adjust the position of the air-handling unit dampers 13, 14 and 16 in order to maintain the supply air temperature at the setpoint value. Adjusting the positions of the dampers varies the relative amounts of outdoor air and return air in the supply air stream within duct 21. It should be understood that some outdoor air always is drawn into the system to supply fresh air to the conditioned building space. In State 2, the heating and cooling coil valves 27 and 29 are closed. A transition back to State 1 occurs after the control of the dampers 13, 14 and 16 has been at the minimum outdoor air position for a time period equal to the state transition delay and the supply air temperature is lower than the setpoint. This condition indicates that mechanical heating is required. A transition to State 3 occurs after dampers 13, 14 and 16 have been at the maximum outdoor air position for a period equal to the state transition delay and the supply air temperature is greater than the setpoint.

In State 3-Mechanical Cooling With Maximum Outdoor Air, feedback control is used to modulate the flow of chilled water to the cooling coil 18, thereby controlling the amount of energy extracted from the air. The outdoor air inlet damper 16 and the exhaust damper 13 are set the fully open position, the recirculation damper is closed, and the heating coil valve 29 is closed. A transition to State 2 occurs after the control signal for mechanical cooling has been saturated at the no cooling position for a time period equal to the state transition delay and the supply air temperature is lower than the setpoint.

Economizer logic is used to control a transition from State 3 to State 4. In the exemplary system, the outdoor air temperature is used to determine the transition point. A transition to State 4 occurs when the outdoor air temperature is greater than the switch over value plus the dead band amount, e.g. about 0.56° C. The dead band amount prevents cycling between States 3 and 4 due to noise in the air temperature sensor readings. As an alternative to solely temperature based economizer logic being used to control the transition to State 4, enthalpy based or combined enthalpy and temperature economizer logic can be used, as is well known in the art.

State 4-Mechanical Cooling With Minimum Outdoor Air also uses feedback control to modulate the flow of cold water to the cooling coil 18, thereby controlling the amount of energy extracted from the air. However, in this case, the outdoor air inlet damper 16 is set at the minimum outdoor air position. Economizer logic is used to determine the transition to State 3 . That transition occurs when the outdoor air temperature, indicated by sensor 23, is less than the switch over value minus the dead band amount.

Figure 3:
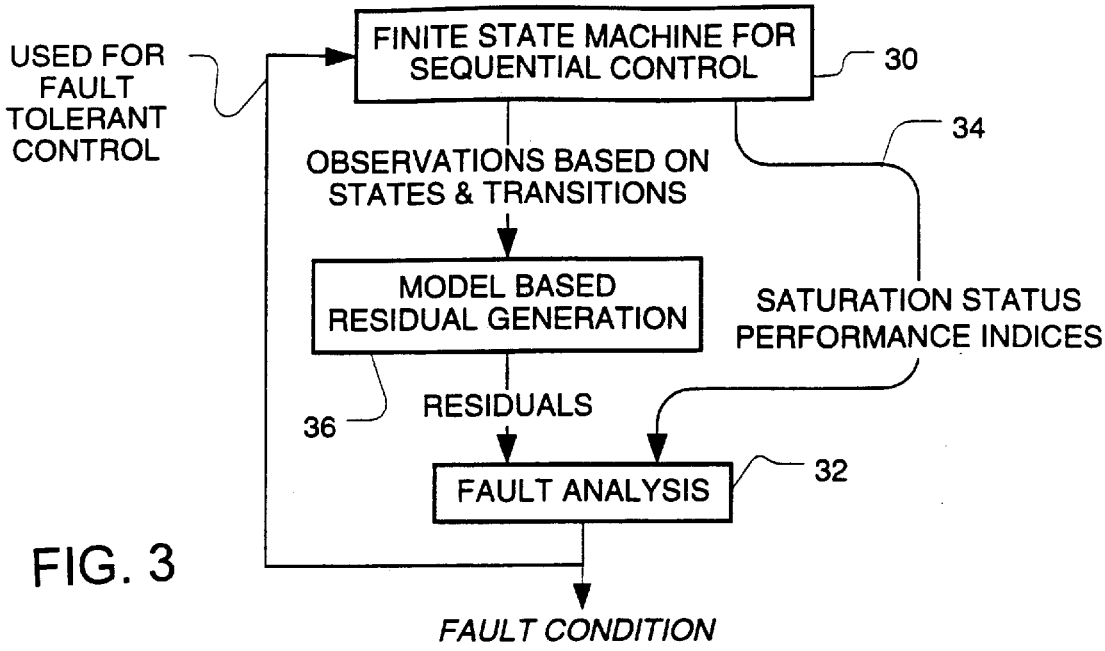
FIG. 3 is a block diagram for the overall structure of the integrated control and fault detection system implemented by the software executed by the controller.

The controller 22 also incorporates fault detection which is based on the current state or a transition occurring. The block diagram of FIG. 3 shows integration of fault detection with the finite state machine 30. As will be described in detail, fault detection is instituted in three cases, (1) when a certain condition occurs in a given state, (2) when a state transition occurs at which point system operating parameters are compared to a mathematical system model, or (3) when there are enough valid sensor data available to permit operating parameters for a given state to be compared with a mathematical system model.

In the first case, a fault condition is declared when the control becomes saturated in a manner that can not be overcome or solved by a transition to another state. Then information about the saturation condition and system performance parameters are passed from the finite state machine software 30 to a fault analysis routine 32 as indicated by line 34. The fault analysis routine 32, that is executed by the controller 22, determines if a fault is present in which case an indication is provided to the system operator and the process control returns to the finite state machine software 30.

For the second case, when a particular transition occurs, observations about the HVAC system operation are passed from the finite state machine program 30 to a model based residual generation software routine 36, which determines residuals based on mass and energy balances of the system. The residuals then are sent to the fault analysis routine 32. Also, if a fault is present, then the finite state machine may switch the mode of operation to maintain control in spite of the fault. That is the controller will enter a state that continues to provide the best possible control of the building environment in spite of the fault condition.

For the third case, when insufficient reliable sensor data is provided, residuals are determined within a the current state.

To do so, observations about the HVAC system operation are passed from the finite state machine program 30 to a model based residual generation software routine 36, which determines residuals based on mass and energy balances of the system. The residuals then are sent to the fault analysis routine 32.

The sophistication of the fault detection is a function of the number of sensors incorporated into the air-handling unit 10. The following is a description of four systems with different types of sensors.

System 1

Consider a first embodiment of the air handling unit 10 shown in FIG. 1 which has only the outdoor air temperature sensor 23 and the supply air temperature sensor 24, but not the return air temperature sensor 25. With additional reference to FIG. 2, the finite state machine in each state monitors whether a non-transition saturation condition exists. In state 1, the heating coil 19 is controlled to maintain the supply air temperature at the setpoint. The dampers 13, 14 and 16 are positioned for minimum outdoor air and there is no mechanical cooling, i.e. chilled water valve 27 is closed.

A fault exists if the controller output is saturated in the maximum heating position, where the controller 22 is unable to heat the air to the setpoint temperature. This saturated condition can result from: the heating capacity of the system being too small, a fouled heat exchanger for the heating coil 19, a stuck heating valve 29, the cooling coil valve 27 leaking when closed, a stuck damper, or the setpoint temperature for the hot water or steam source being too low. Upon concluding that a fault condition exits, the controller may provide a fault indication and a list of the possible causes to an HVAC system operator for the building.

In state 2, the dampers 13, 14 and 16 alone are used to control the supply air temperature. Because there is no heating or mechanical cooling, the inability to achieve the setpoint temperature results in a transition to either State 1 or 3. Therefore a fault can not be declared in this state. Note that a transition to State 3 is indicated using the nomenclature β/S, where β is the transition trigger event and S is an action that occurs upon the transition. In this case, the action is a comparison of the outdoor and supply air temperatures.

In state 3, the cooling coil 18 is controlled to maintain the supply air temperature at the setpoint with the dampers 13, 14 and 16 positioned for maximum outdoor air to be brought into the rooms. Obviously there is no heating in this state.

A fault exists if the controller output is saturated in the maximum cooling position, thus being unable to cool the air sufficiently. There are a number of possible errors that could cause this condition: inadequate cooling capacity, fouled heat exchanger for the cooling coil 18, a stuck cooling coil valve 27, the heating coil valve 29 leaking in the closed position, or the setpoint temperature for the chilled water source is too high.

In state 4, a cooling coil 18 is controlled to maintain the supply air temperature with the dampers 13, 14 and 16 positioned for minimum outdoor air and no heating. A fault exists in State 4 when the control is saturated in the maximum cooling position as the system can not cool the air sufficiently. The potential causes for this fault are the same as for a fault in State 3.

A fault also exists in State 4 when control is saturated in the no cooling position when the outdoor air temperature is greater than the setpoint for the supply air temperature. That greater outdoor air temperature indicates a need for mechanical cooling, but the controller 22 is not issuing a command for cooling. The only explanations for this mode is that the air is being unintentionally cooled or there is a sensor fault.

The fault detection technique also examines observations about the HVAC system operation which are taken during selected state transitions. Those observations are applied to a model based residual generation software routine 36, which determines residuals based on an energy balance of the system. The residuals indicate the degree to which the observations match the system performance predicted by the mathematical system model. The values of the residuals are then analyzed to determine whether a fault exists.

In exemplary System 1 which has sensors 23 and 24 for only the outdoor and supply air temperatures, respectively, only transitions between States 2 and 3 are observed for fault detection. Thus, when the damper control saturates in the 100% outdoor air position in State 2, the outdoor and supply air temperatures are recorded before a transition to State 3 occurs. These values are used in a mathematical model of the system in these two states.

In that model the control system should be at nearly steady-state conditions when the damper control signal is saturated in the 100% outdoor air position. Assuming the system is at steady-state conditions and performing a mass balance for the dry air entering and leaving the control volume 28 of the air handling unit in FIG. 1 gives:

$$\dot{m}_o=\dot{m}_s \qquad \text{Eq. 1}$$

where $\dot{m}_o$ is the mass of dry air entering the control volume 28 from the outside and $\dot{m}_s$ is the mass of dry air leaving the control volume through the supply air duct. Performing a mass balance on the water vapor results in $$\dot{m}_o\omega_o=\dot{m}_s\omega_s \qquad \text{Eq. 2}$$

where $\omega_o$ and $\omega_s$ are the humidity ratio of the outside air and supply air, respectively. Substituting equation 1 into equation 2 gives:

$$\omega_o=\omega_s \qquad \text{Eq. 3}$$

Performing an energy balance on the control volume 28, with the assumption that the kinetic and potential energy of the air entering and leaving the control volume are the same, yields:

$$\dot{m}_o h_o+\dot{W}_{fan}=\dot{m}_s h_s \qquad \text{Eq. 4}$$

where $\dot{W}_{fan}$ is the work performed by the supply fan 20, $h_o$ is the enthalpy of the air entering the control volume 28, and $h_s$ is the enthalpy of the air leaving the control volume 28 through the supply duct.

Assuming that air can be modeled as an ideal gas at the temperatures found in HVAC systems, the enthalpy of air given by:

$$h=c_pT+\omega h_{g0} \qquad \text{Eq. 5}$$

where $c_p$ is the specific heat of the mixture, T is temperature and $h_{g0}$ is the enthalpy of the water vapor at the reference state. The specific heat of the mixture is determined from:

$$c_p=c_{pa}+\omega c_{pw} \qquad \text{Eq. 6}$$

where $c_{pa}$ is the specific heat at constant pressure of dry air and $c_{pw}$ is the specific heat at constant pressure of water vapor. Substituting equation 5 into equation 4 gives $$\dot{m}_o(c_pT_o+\omega_o h_{g0})+\dot{W}_{fan}=\dot{m}_s(c_pT_s+\omega_s h_{g0}) \qquad \text{Eq. 7}$$

Substituting equations 1 and 3 into equation 7 and solving for a temperature difference gives $$T_s - T_o = \frac{\dot{W}_{fan}}{\dot{m}_s c_p} \quad \text{Eq. 8}$$

where $T_o$ is the temperature of the air entering the control volume 28 and $T_s$ is the temperature of the supply air leaving that control volume. The temperature difference is due to the energy gained from the fan.

The variables on the right side of Equation 8 can be estimated from design data. Using the recorded temperatures, after the controller output is saturated in the 100% outdoor air position, a residual is computed by the expression:

$$r_1 = T_{s,2\to3} - T_{o,2\to3} - \frac{\hat{\dot{W}}_{fan}}{\hat{\dot{m}}_s \hat{c}_p} \quad \text{Eq. 9}$$

where $T_{s,2\to3}$ and $T_{o,2\to3}$ are the recorded supply and outdoor air temperatures following the transition from state 2 to state 3, and the symbol ^ over the variables on the right side of equation 8 indicates an estimated value. The residual may be non-zero for a number of reasons: sensor errors, errors in the estimated values, modeling errors, or faults.

Several methods can be employed to detect faults from the $r_1$ residual and other residuals. For example, a fault occurs when the residual is greater than a upper threshold value, or is less than a lower threshold value. The specific threshold values are determined empirically for each particular type of air handling unit. In a second fault detection method, the residuals are stored and statistical quality control techniques are used to determine when the time series of the residuals goes through a significant change. A significant change can be determined by outlier detection methods as described by P. J. Rousseeuw et al., *Robust Regression and Outlier Detection*, Wiley Series in Probability and Mathematical Statistics, John Wiley & Sons, 1987, the methods for detecting abrupt changes presented by Basseville and Nikiforov in *Detection of Abrupt Changes: Theory and Applications*, Prentice Hall Information and System Science Series, April 1993, or methods for statistical quality control described by D. C. Montgomery in *Introduction to Statistical Quality Control*, 3rd edition, John Wiley & Sons, August 1996.

The transition from State 3 to State 2 occurs after the control signal is saturated in the no cooling position. The supply and outdoor air temperatures are recorded. Then a residual is determined from:

$$r_2 = T_{s,3\to2} - T_{o,3\to2} - \frac{\hat{\dot{W}}_{fan}}{\hat{\dot{m}}_s \hat{c}_p} \quad \text{Eq. 10}$$

Equation 10 was developed in a similar manner to equation 9 described previously. This model based residual then is used determine when faults occur.

In state 4, the cooling coil 18 is controlled to maintain the supply air temperature at the setpoint. Also, the outdoor and return air temperatures are greater than the supply air temperatures. Consequently, the mixed air temperature will be greater than the supply air temperature. If the control signal for the cooling coil 18 is saturated in the no cooling position, then a fault exists. Two possible causes for the fault would be cooling coil valve 18 stuck in an open position or a faulty sensor reading. The control strategy is fault tolerant in that if a fault occurs, the control switches from State 4 to State 1 to correct for the fault. For the case of a stuck cooling coil valve, energy would be wasted but the control of supply air temperature would be maintained. If the state transition diagram does not have the transition from State 4 to State 1, then the control would not be maintained for this fault.

System 2

Figure 4:
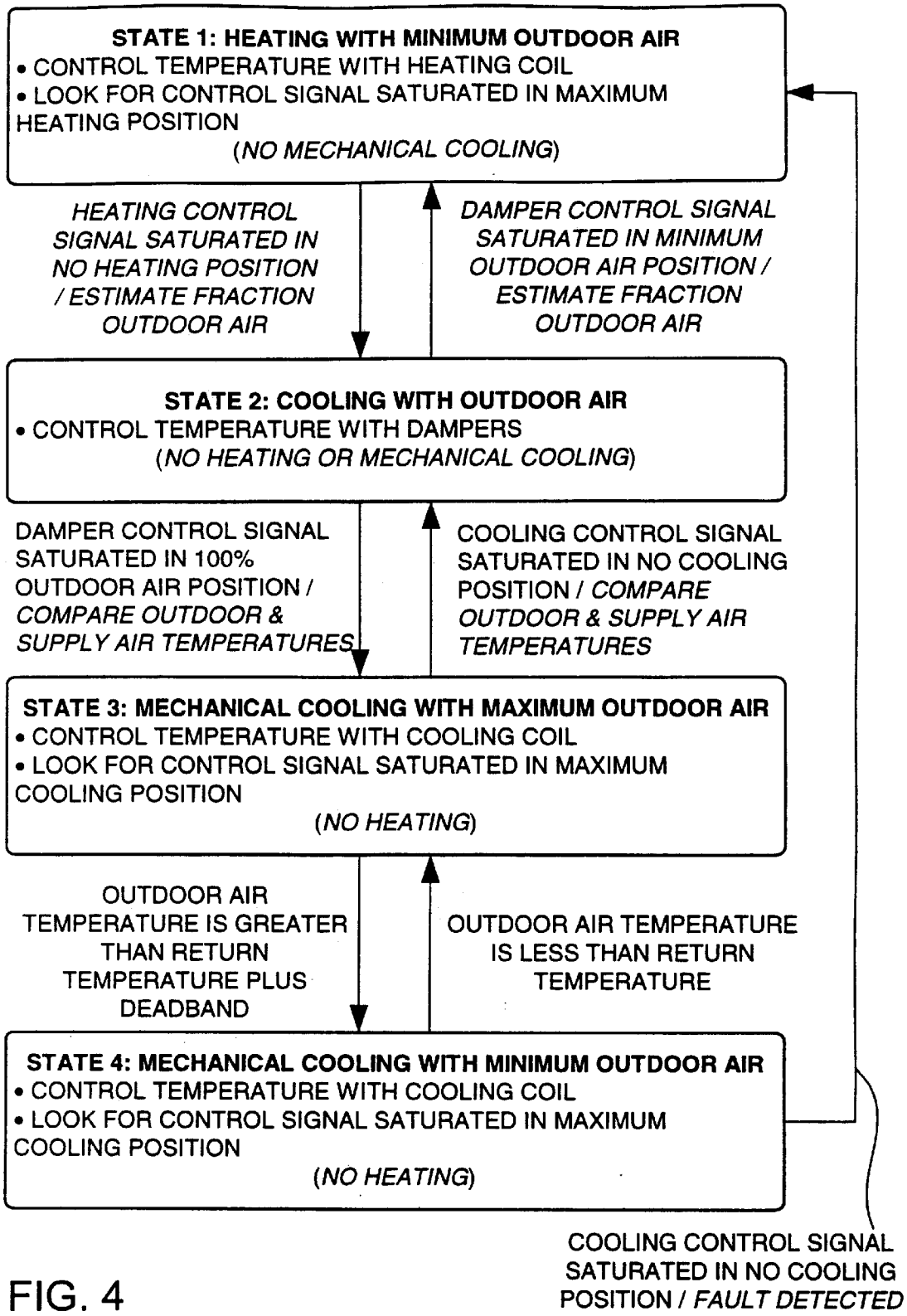
FIG. 4 is a state machine diagram for operation of the controller in a second embodiment of an air handling unit.

FIG. 4 shows the state transition diagram for the integrated control and diagnosis of a single duct air-handling unit 10 with supply, outdoor and return air temperature sensors 23, 24, 25. The fault detection for System 2 is identical to System 1 described previously, except for the transitions between States 1 and 2 at which times the minimum fraction of outdoor air is estimated. The estimated minimum fraction of outdoor air is compared with the design value for that parameter.

Equations for estimating the minimum fraction of outdoor air are derived by performing a mass balance for the dry air entering and leaving the control volume 28 in FIG. 1 which gives:

$$\dot{m}_o + \dot{m}_r = \dot{m}_s \quad \text{Eq. 11}$$

where $\dot{m}_o$ is the mass of dry return air. Performing a steady-state energy balance on the control volume yields:

$$\dot{m}_o h_o + \dot{m}_r h_r + \dot{W}_{fan} = \dot{m}_s h_s \quad \text{Eq. 12}$$

where $h_r$ is the enthalpy of return air. Substituting the solution of equation 11 for $\dot{m}_r$ into equation 12 and rearranging results produces the following equation for the fraction of outdoor air to supply air:

$$\frac{\dot{m}_o}{\dot{m}_s} = \frac{h_s - h_r - \left(\frac{\dot{W}_{fan}}{\dot{m}_s}\right)}{h_r - h_o} \quad \text{Eq. 13}$$

The enthalpy of air is determined from:

$$h = (c_{pa} + \omega c_{pw})T \quad \text{Eq. 14}$$

from which air conditioning engineers sometimes use the approximation:

$$h \approx c_{pa} T \quad \text{Eq. 15}$$

when determining the mixed air condition of two air streams. Substituting equation 15 into equation 13 gives the fraction of outdoor air $$f = \frac{\dot{m}_o}{\dot{m}_s} \approx \frac{c_{pa}(T_s - T_r) - \left(\frac{\dot{W}_{fan}}{\dot{m}_s}\right)}{c_{pa}(T_r - T_o)} \quad \text{Eq. 16}$$

The following equation can be used to estimate the fraction of the outdoor air ($f$) during the transition from state 1 to state 2:

$$\hat{f}_{1\to2} = \frac{c_{pa}(T_{s,1\to2} - T_{r,1\to2}) - \left(\frac{\hat{\dot{W}}_{fan}}{\hat{\dot{m}}_s}\right)}{c_{pa}(T_{r,1\to2} - T_{o,1\to2})} \quad \text{Eq. 17}$$

where $T_{s,1\to2}$, $T_{r,1\to2}$, $T_{o,1\to2}$ are the supply, return, and outdoor temperatures at the transition from state 1 to state 2.

When an HVAC system is designed a desired minimum fraction of outdoor air is calculated to meet ventilation requirements. The actual fraction of outdoor air usually is different than the estimated fraction of outdoor air. If the desired minimum fraction of outdoor air is significantly different than the estimated fraction of outdoor air, after taking consideration for the sensor and modeling errors, then the fault analysis should issue a fault command. The following residual is determined from the desired minimum fraction of outdoor air:

$$r_3=\hat{f}_{design}-\hat{f}_{1\to 2} \quad \text{Eq. 18}$$

The fraction of outdoor air during the transition from State 2 to State 1 can be estimated with $$\hat{f}_{2\to 1}=\frac{c_{pa}(T_{s,2\to 1}-T_{r,2\to 1})-\left(\frac{\hat{\dot{W}}_{fan}}{\hat{\dot{m}}_s}\right)}{c_{pa}(T_{r,2\to 1}-T_{o,2\to 1})} \quad \text{Eq. 19}$$

where $T_{s,2\to 1}$, $T_{r,2\to 1}$, and $T_{o,2\to 1}$ are the supply, return, and outdoor temperatures during the transition from state 1 to state 2. Following is a residual based on the estimated minimum fraction outdoor air and the design minimum fraction outdoor air:

$$r_4=\hat{f}_{design}-\hat{f}_{2\to 1} \quad \text{Eq. 20}$$

Equations 19 and 20 were developed in a similar manner as equations 17 and 18.

System 3

Figure 6:
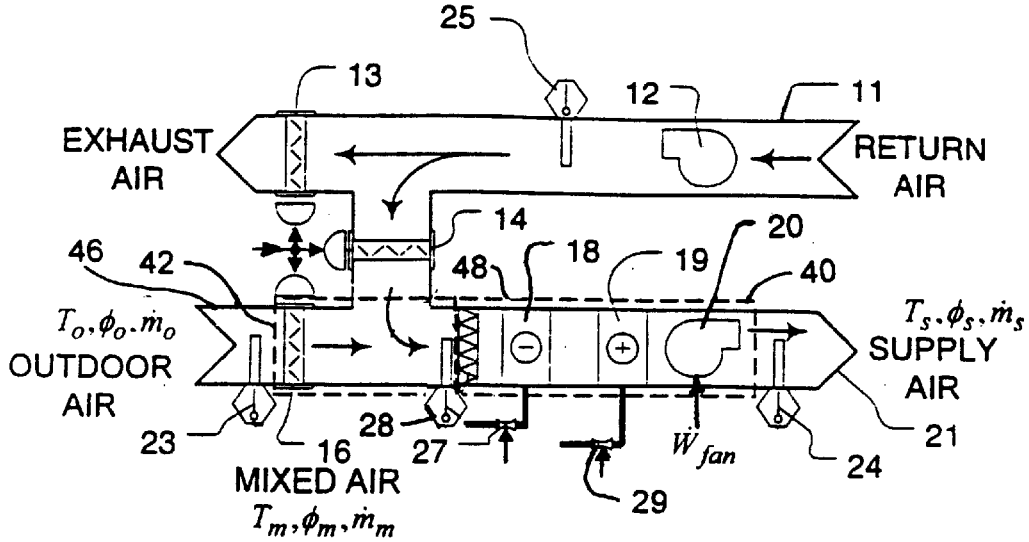
FIG. 6 is a schematic diagram of a variable air volume air handling unit used in previous HVAC systems.
Figure 5:
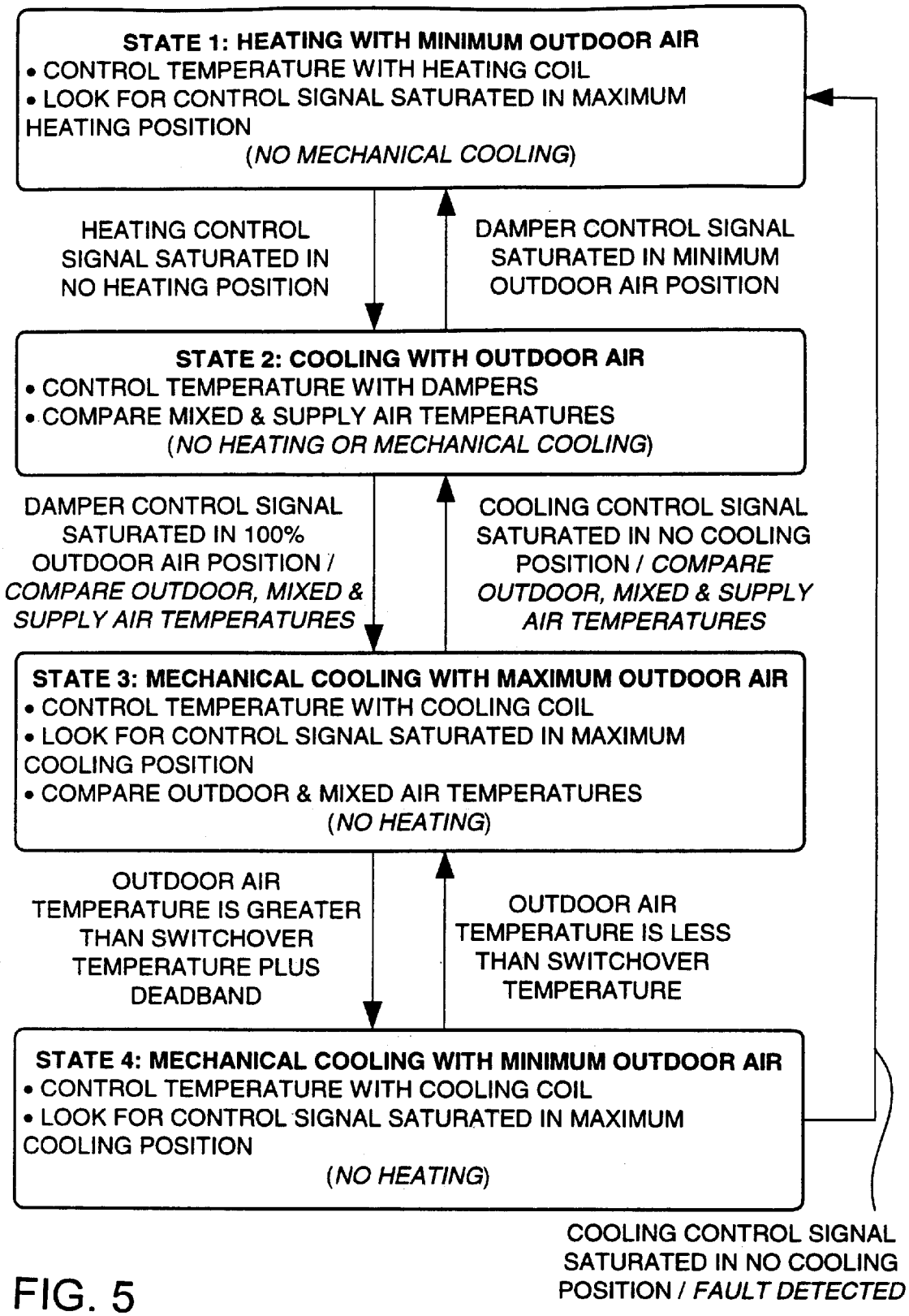
FIG. 5 is a state machine diagram for operation of the controller in a third embodiment of an air handling unit.

FIG. 5 shows a state transition diagram for integrated control and diagnosis of a single duct air-handling unit 50 in FIG. 6 with supply, mixed, and outdoor air temperature sensors 23, 28 and 24, respectively. The fault detection for System 3 is identical to System 1, except for the operation in States 2 and 3 and the transitions between States 2 and 3. Four additional residuals are determined for System 3: one of which is determined in State 2, another is determined in State 3, a third residual is determined during the transition from State 2 to State 3, and the final residual is determined during the transition from State 3 to State 2.

The residual for State 2 is determined by performing a mass and energy balance on the control volume 40 shown in FIG. 6. The mass balance for dry air and water vapor gives:

$$\dot{m}_m=\dot{m}_s \quad \text{Eq. 21}$$

$$\dot{m}_m\omega_m=\dot{m}_s\omega_s \quad \text{Eq. 22}$$

where $\dot{m}_o$ is the mass of the mixed air and $\omega_s$ is the mixed air humidity ratio. Substituting equation 21 into 22 gives $$\omega_m=\omega_s \quad \text{Eq. 23}$$

Performing an energy balance on the control volume 40 in FIG. 6 gives $$\dot{m}_m h_m+\dot{W}_{fan}=\dot{m}_s h_s \quad \text{Eq. 24}$$

Equation 24 assumes that the potential and kinetic energy of the air entering and leaving the control volume are the same. Substituting equations 5, 21, and 23 into equation 24 and rearranging results in:

$$T_s-T_m=\frac{\dot{W}_{fan}}{\dot{m}_s c_p} \quad \text{Eq. 25}$$

Equation 25 states that the temperature rise between the supply air temperature sensor and the mixed air temperature sensor is due to the energy input from the fan.

While in State 2, the supply and mixed air temperatures should be measured. Then, the residual is computed from:

$$r_5=T_{s,2}-T_{m,2}-\frac{\hat{\dot{W}}_{fan}}{\hat{\dot{m}}_s\hat{c}_p} \quad \text{Eq. 26}$$

where $T_{s,2}$ and $T_{m,2}$ are supply air and mixed air temperatures while in State 2.

In State 3, the cooling coil 18 is controlled to maintain the supply air temperature at setpoint. The dampers 13, 14, and 16 should be positioned to allow 100% outdoor air to enter the air handling unit 50 with no recirculation air in this state. The residual is determined by performing mass and energy balances on the control volume 42 shown in FIG. 6.

Performing a mass balance for the dry air entering and leaving the control volume in FIG. 6 gives $$\dot{m}_o=\dot{m}_m \quad \text{Eq. 27}$$

and performing a mass balance on the water vapor gives $$\dot{m}_o\omega_o=\dot{m}_m\omega_m \quad \text{Eq. 28}$$

Performing an energy balance on control volume in FIG. 6 results in $$\dot{m}_o h_o=\dot{m}_m h_m \quad \text{Eq. 29}$$

Equation 29 assumes the kinetic and potential energy of the air entering and leaving the control volume is the same. Substituting equations 14, 27, and 28 into equation 29 gives:

$$T_{o,3}=T_{m,3} \quad \text{Eq. 30}$$

Equation 30 states that the outdoor air temperature should equal the mixed air temperature while in State 3. Because of sensor errors, modeling errors, or faults the outdoor air temperature may not be equal to the mixed air temperature. A residual for fault analysis can be determined from:

$$r_6=T_{o,3}-T_{m,3} \quad \text{Eq. 31}$$

Three additional residuals are determined during the transition from State 2 to State 3. One of the residuals is determined from equation 9. The other two residuals are determined by performing mass and energy balances for the control volumes 40 and 42 shown in FIG. 6.

The following residuals are determined from mass and energy balances on the control volumes 40 and 42:

$$r_7=T_{s,2\to 3}-T_{m,2\to 3}-\frac{\hat{\dot{W}}_{fan}}{\hat{\dot{m}}_s\hat{c}_p} \quad \text{Eq. 32}$$

$$r_8=T_{o,2\to 3}-T_{m,2\to 3} \quad \text{Eq. 33}$$

Equation 32 was developed in a similar manner as equation 26, and equation 33 was derived in a similar manner to equation 31.

During the transition from State 3 to State 2, the following residuals are derived based on observations $$r_9 = T_{o,3\to 2} - T_{m,3\to 2} \quad \text{Eq. 34}$$

$$r_{10} = T_{s,3\to 2} - T_{o,3\to 2} - \frac{\hat{W}_{fan}}{\hat{m}_s \hat{c}_p} \quad \text{Eq. 35}$$

As with the prior systems the calculated residuals are examined to determine whether a fault condition exists. That fault detection process can comprise comparing the residuals to thresholds or using statistical techniques to determine when the time series of the residuals goes through a significant change.

System 4

Figure 7:
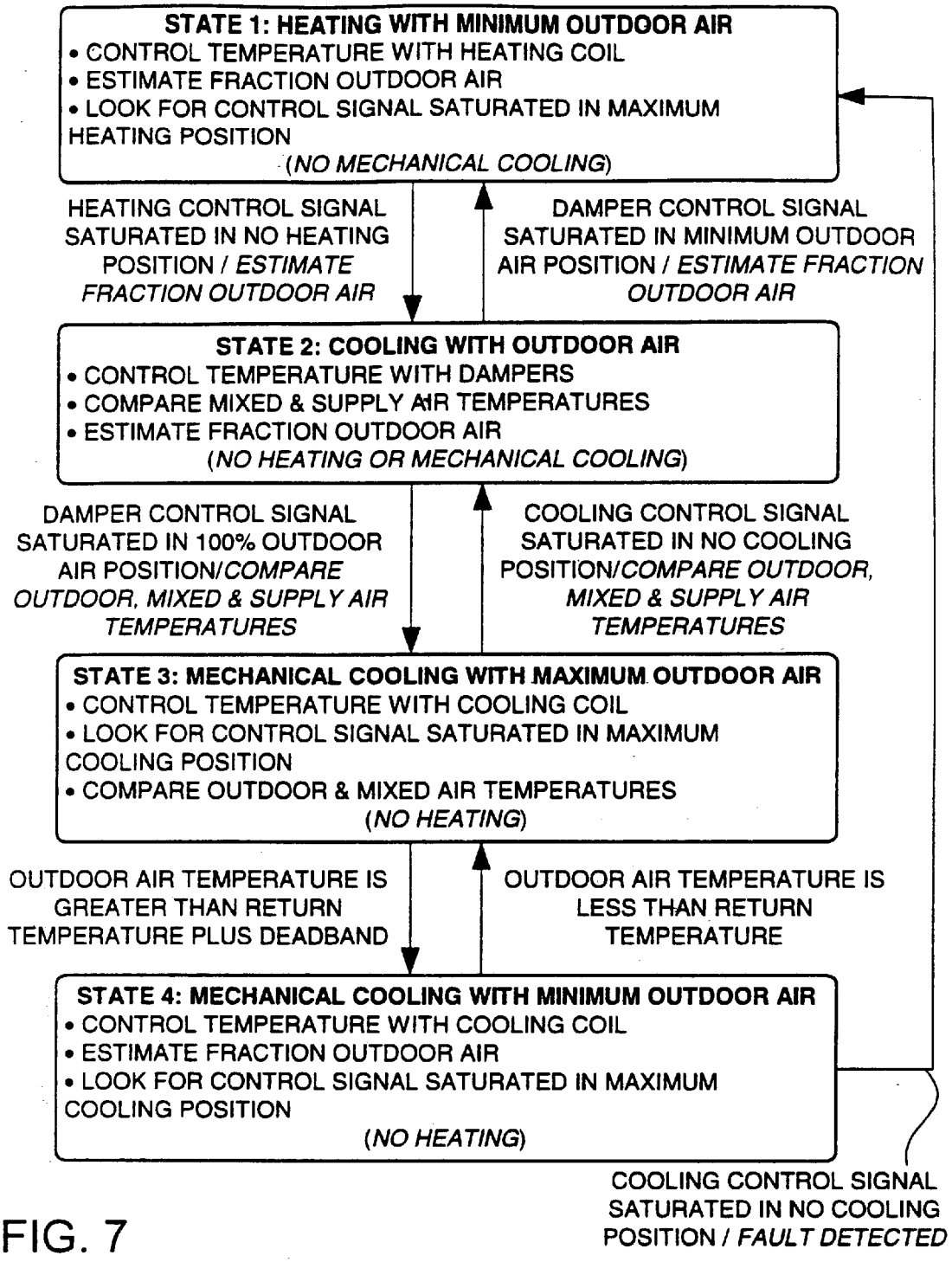
FIG. 7 is a state machine diagram for operation of the controller in a fourth embodiment of an air handling unit.

FIG. 7 shows the state transition diagram for controlling an air-handling unit 50 as in FIG. 6 with outdoor, supply, return, and mixed air temperature sensors 23, 24, 25 and 28, respectively.

In State 1 of this system, the supply air temperature is maintained by controlling the heating coil 19 and checking the saturation status of the heating control signal. A fault exists if the heating control signal is saturated in the maximum heating position. An estimate of the fraction of outdoor air is determined from return, outdoor, and mixed air temperature readings. To estimate the fraction of outdoor air, mass and energy balances are performed on the control volume 42 shown in FIG. 6. Performing a mass balance on the dry air and water vapor gives:

$$\dot{m}_o + \dot{m}_r = \dot{m}_m \quad \text{Eq. 36}$$

Performing an energy balance results in $$\dot{m}_o h_o + \dot{m}_r h_r = \dot{m}_m h_m \quad \text{Eq. 37}$$

Substituting equations 36 and 15 into equation 37 and solving for the fraction of outdoor air to mixed air gives:

$$f = \frac{\dot{m}_o}{\dot{m}_m} \approx \frac{T_m - T_r}{T_o - T_r} \quad \text{Eq. 38}$$

In State 1, the dampers are positioned to allow the minimum amount of outdoor air required for ventilation. An HVAC engineer can use conventional methods to determine the desired minimum fraction of outdoor air in the supply air duct 21. Using this minimum fraction of outdoor air and the measured temperatures in the return air duct 11, outdoor air duct 46, and mixed air duct 48, the following residual is computed:

$$r_{11} = f_{design} - \frac{T_{m,1} - T_{r,1}}{T_{o,1} - T_{r,1}} \quad \text{Eq. 39}$$

In State 2 of System 4, the dampers 13, 14 and 16 are modulated to control the supply air temperature. Equation 26 is used to determine residual $r_5$ as described previously and another residual is determined from the equation:

$$r_{12} = f_{design} - \frac{T_{m,2} - T_{r,2}}{T_{o,2} - T_{r,2}} \quad \text{Eq. 40}$$

Equation 40 was developed in a similar manner as equation 39.

In State 3, the dampers 13, 14 and 16 are positioned to allow 100% outdoor air into the air-handling unit 50. The cooling coil 18 is used to control the supply air temperature. If the cooling coil 18 becomes saturated in the maximum cooling position, then a fault exists. A fault also exists if residual $r_6$ as determined from equation 31 goes through a significant change.

In state 4, the dampers 13, 14 and 16 are positioned to admit a minimum amount of outdoor air required for ventilation, and the cooling coil 18 is used to maintain the supply air temperature at the desired setpoint. A fault exits if the control signal for the cooling coil 18 becomes saturated in either the maximum cooling or no cooling positions. In addition a residual $r_{13}$ is determined in this state according to the expression:

$$r_{13} = f_{design} - \frac{T_{m,3} - T_{r,3}}{T_{o,3} - T_{r,3}} \quad \text{Eq. 41}$$

It is expected that the variances of residuals $r_{11}$, $r_{12}$, and $r_{13}$ will be different because the denominator of the term on the right side of the residual equations will vary.

Other residuals are produced during selected state transitions in System 4. During the transition from State 1 to State 2, we determine residual $r_3$ with equation 18. The transition from State 2 to State 1 causes residual $r_4$ to be produced according to equation 20. During the transition from State 2 to State 3, three residuals $r_1$, $r_7$, and $r_8$ are calculated by equations 9, 32 and 33, respectively. A transition from State 3 to State 2, produces residuals $r_2$, $r_9$, and $r_{10}$ using equations 10, 34 and 35, respectively.

What is claimed is:

1. In a finite state machine controller for a heating, ventilating and air conditioning (HVAC) system for a building, wherein the state machine controller has a plurality of states and makes transitions between states upon the occurrence of predefined conditions, a fault detection method comprising:

gathering operational data regarding performance of the HVAC system;

evaluating the operational data against predefined criteria for a current state in which the finite state machine controller is operating or for a given transition which has occurred; and based on the evaluating step determining whether an fault condition exists.

2. The method as recited in claim 1 wherein the predefined criteria indicates that control of the HVAC system has become saturated in the current state.

3. The method as recited in claim 1 wherein the predefined criteria indicates that control of the HVAC system has become saturated in the current state and saturation can not be overcome by a transition to another state.

4. The method as recited in claim 1 wherein evaluating the operational data is performed when a predetermined transition occurs between states and comprises comparing the performance of the HVAC system to a mathematical system model of the HVAC system.

5. The method as recited in claim 1 wherein evaluating the operational data is performed when a predetermined transition occurs between states and comprises:

comparing the performance of the HVAC system to a mathematical system model of the HVAC system to derive a residual; and declaring a fault condition in response to the residual.

6. The method as recited in claim 5 wherein the residual has a numerical value and the fault condition is declared in response to the magnitude of the numerical value.

7. The method as recited in claim 5 wherein the fault condition is declared in response to detecting a predefined change in the residual.

8. The method as recited in claim 5 wherein the fault condition is declared in response to detecting an abrupt change in the residual.

9. The method as recited in claim 5 wherein the residual is a function of at least two of a temperature of air outside the building, a temperature of air supplied by the HVAC system, temperature of air returned to the HVAC system from a room of the building, and a temperature of a mixture of air from outside the building and the air returned to the HVAC system.

10. The method as recited in claim 5 wherein the residual is derived from a mass balance for dry air entering and leaving a space of the building controlled by the HVAC system.

11. The method as recited in claim 5 wherein the residual is a function of a fraction of outdoor air utilized by the HVAC system.

12. The method as recited in claim 5 wherein the residual is derived from an energy balance for air entering and leaving the HVAC system.

13. In a finite state machine controller for a heating, ventilating and air conditioning (HVAC) system for a building, wherein the state machine controller has a plurality of states and makes transitions between states upon the occurrence of predefined conditions, a fault detection method comprising:

gathering operational data regarding performance of the HVAC system in the given state;

detecting when control of the HVAC system becomes saturated in a given state wherein such saturation can not be overcome by a transition to another state; and issuing a signal that indicates an occurrence of a fault condition.

14. The method as recited in claim 13 further comprising issuing an indication of possible causes of the fault condition.

15. In a finite state machine controller for a heating, ventilating and air conditioning (HVAC) system for a building, wherein the state machine controller has a plurality of states and makes transitions between states when predefined conditions exist, a fault detection method comprising:

gathering operational data regarding performance of the HVAC system in the given state;

occasionally comparing performance of the HVAC system to a model of HVAC system performance; and declaring a fault condition in response to results of the comparing.

16. The method as recited in claim 15 wherein the step of occasionally comparing is performed in response to a transition occurring.

17. The method as recited in claim 15 wherein the occasionally comparing produces a residual; and the fault condition is declared in response to a value of the residual.

18. The method as recited in claim 17 wherein the fault condition is declared in response to detecting a predefined change in the residual.

19. The method as recited in claim 17 wherein the fault condition is declared in response to detecting an abrupt change in the residual.

20. The method as recited in claim 17 wherein the residual is a function of at least two of a temperature of air outside the building, a temperature of air supplied by the HVAC system, temperature of air returned to the HVAC system from a room of the building, and a temperature of a mixture of air from outside the building and the air returned to the HVAC system.

21. The method as recited in claim 17 wherein the residual is derived from a mass balance for dry air entering and leaving a space of the building controlled by the HVAC system.

22. The method as recited in claim 17 wherein the residual is a function of a fraction of outdoor air utilized by the HVAC system.

23. The method as recited in claim 17 wherein the residual is derived from an energy balance for air entering and leaving the HVAC system.

24. The method as recited in claim 15 further comprising providing an indication of possible causes of the fault condition.

* * * * *